US007954976B1

(12) United States Patent
Berge

(10) Patent No.: US 7,954,976 B1
(45) Date of Patent: Jun. 7, 2011

(54) MULTI-USE ADAPTOR KIT/SYSTEM FOR RECESSED CAN FIXTURES

(76) Inventor: Arthur J. Berge, Murrieta, CA (US)

( * ) Notice: Subject to any disclaimer, the term of this patent is extended or adjusted under 35 U.S.C. 154(b) by 237 days.

(21) Appl. No.: 12/141,353

(22) Filed: Jun. 18, 2008

Related U.S. Application Data

(60) Provisional application No. 60/945,072, filed on Jun. 19, 2007.

(51) Int. Cl.
*F21V 21/14* (2006.01)

(52) U.S. Cl. ..... 362/148; 362/364; 362/365; 362/404

(58) Field of Classification Search ..... 362/147, 362/148, 364, 365, 366, 404, 408, 150; 248/231.21
See application file for complete search history.

(56) References Cited

U.S. PATENT DOCUMENTS 3,304,954 A * 2/1967 Kaiser ..... 138/112
6,979,108 B1 12/2005 Berge

* cited by examiner

*Primary Examiner* — Laura Tso
(74) *Attorney, Agent, or Firm* — Wallace G. Walter

(57) ABSTRACT

An adaptor kit or system for use with conventional can light fixtures to adapt the can light fixture for use as a hanger assembly for auxiliary fixtures, such as a hanging lamp, a flush-mounted lamp or the like, includes an expandable/retractable shoe assembly with surfaces to forcibly engage the inner surface of a can with sufficient engagement thereto to install an auxiliary fixture. In the preferred embodiment, the shoe assembly is defined by two individual shoes connected by threaded nut/screw assemblies so that the nut/screw assemblies can be adjusted to cause the shoes to extend outwardly to effect a usable mounting.

19 Claims, 7 Drawing Sheets

MULTI-USE ADAPTOR KIT/SYSTEM FOR RECESSED CAN FIXTURES

CROSS-REFERENCE TO RELATED APPLICATION

This application claims the benefit of U.S. Provisional Patent Application 60/945,072 filed Jun. 19, 2007 by the inventor herein, the disclosure of which is incorporated herein by reference.

BACKGROUND OF THE INVENTION

The present invention relates to an adaptor or conversion kit or system for use with "can light" or "can fixture" assemblies to adapt the can light for other uses, including, for example, use as a hanger for a suspended or hanging lamp, a flush-mount lamp, or other devices that are designed to be attached to or modified for attachment to a can light assembly.

Recessed ceiling lighting fixtures are located within or recessed within a ceiling. A light bulb or other type of lamp is located within the housing and is positioned so that the lowermost point of the lamp is somewhat above, flush with, or slightly below the ceiling. Lighting fixtures of this type, also known as "can lights" or "can fixtures," are well known in both new construction and in retrofit situations due, in part, to the unobtrusive nature of the fixtures themselves and their desirable illumination pattern.

A representative example of a "can light" assembly of the type used in new construction is shown in side elevation view in FIG. 1 and is designated therein by the reference character 10. The particular organization and structure shown is exemplary only and is representative of a widely variety of can light fixtures marketed by various manufacturers. As shown, the fixture 10 includes a frame or frame-like pan structure 12 which mounts an electrical junction box 14 and a can 16. The can 16 and the junction box 14 are connected by a standard conduit 18 through which insulated wiring (not shown) extends from the junction box 14 to the interior of the can 16 to provide power to a lamp (not shown) within the can 16. The frame structure 12 is mounted by adjustable hanger bar assemblies 22 (only one of which is shown) between joists (not shown) above a ceiling in which an appropriately sized opening is formed.

The can 16 is typically formed from thin-walled metal, such as aluminum, that is pressed into shape as a dome-like surface of revolution about a central axis $A_x$; in some designs, the can is formed as a cylinder and, in other designs, the can is formed from two or more pieces. The can 16 is often designed to be moved or adjusted vertically (i.e., along the up/down axis $A_x$) throughout a limited range of motion in its frame 12. In general, the diameter of the open, lower end of the can for the majority of manufacturers in the can light market is between three and eight inches, although some manufacturers will provide cans with somewhat larger open, lower ends.

As also shown in FIG. 1, a lamp socket assembly 20 (shown in dotted-line illustration) is mounted on or attached to an interior surface portion of the can 16; electrical wires (dotted-line illustration) extend from the socket assembly 20 through an opening (not specifically shown) and through the conduct 18 to the junction box 14. In FIG. 1, the lamp socket 20 is shown as a classic screw-base type socket; as can be appreciated other types of sockets, including more recent pin-type sockets can be used.

In a normal or typical installation, a lamp, such as an incandescent or a fluorescent lamp, (not shown) is threaded into or otherwise coupled to the socket 20 to provide illumination. In the case of the present invention and as explained below, an "adaptor" 24 is threaded into or otherwise coupled to the socket 20 in lieu of a conventional light bulb or lamp. A pair of wires W1 and W2 extend from the adaptor 24 and provide power as explained below.

Can light fixtures of the type described above are in common usage and perform their lighting function as intended. However and because can light fixtures are "single function" devices, they lack a certain flexibility for use in related functions, such as a support for a hanging or suspended lamp or lighting fixture or as a support for a flush-mounted ceiling lamp.

SUMMARY OF THE INVENTION

In view of the above, it is an object of the present invention, among others, to provide an adaptor kit or system for use with conventional can light fixtures to adapt the can light fixture for use as a hanger assembly for hanging or suspended lamps or pendant lamps, including chandeliers, and to adapt the can light assembly for other types of non-recessed lamps, including flush-mounted lamps.

In a preferred embodiment, surface engagement shoes are assembled into a shoe assembly providing a pair of outwardly facing engagement surfaces intended to engage inner surfaces at or adjacent the open end of a can light. The surface engagement shoes are connected by mechanisms which allow the shoes to move to a retracted position and move to an extended position by which a forcible engagement is effected. When installed within the can light, the shoe assembly can then be used as connection point for a pendant or hanging lamp, a flush-mount lamp, or other devices that are designed to be attached to or modified for attachment to a can light assembly.

In a more specific form, a pair of surface engagement shoes are provided having engagement surface that approximately conform to the inner surface of the can. The surface engagement shoes are connected by threaded screw and threaded nut assemblies so that the shoes extend away from one another when the screw/nut assembly is adjusted in one direction to forcibly engage inner surfaces of the can to effect an installation of the adaptor kit therein.

DESCRIPTION OF THE PREFERRED EMBODIMENTS

Figure 1:
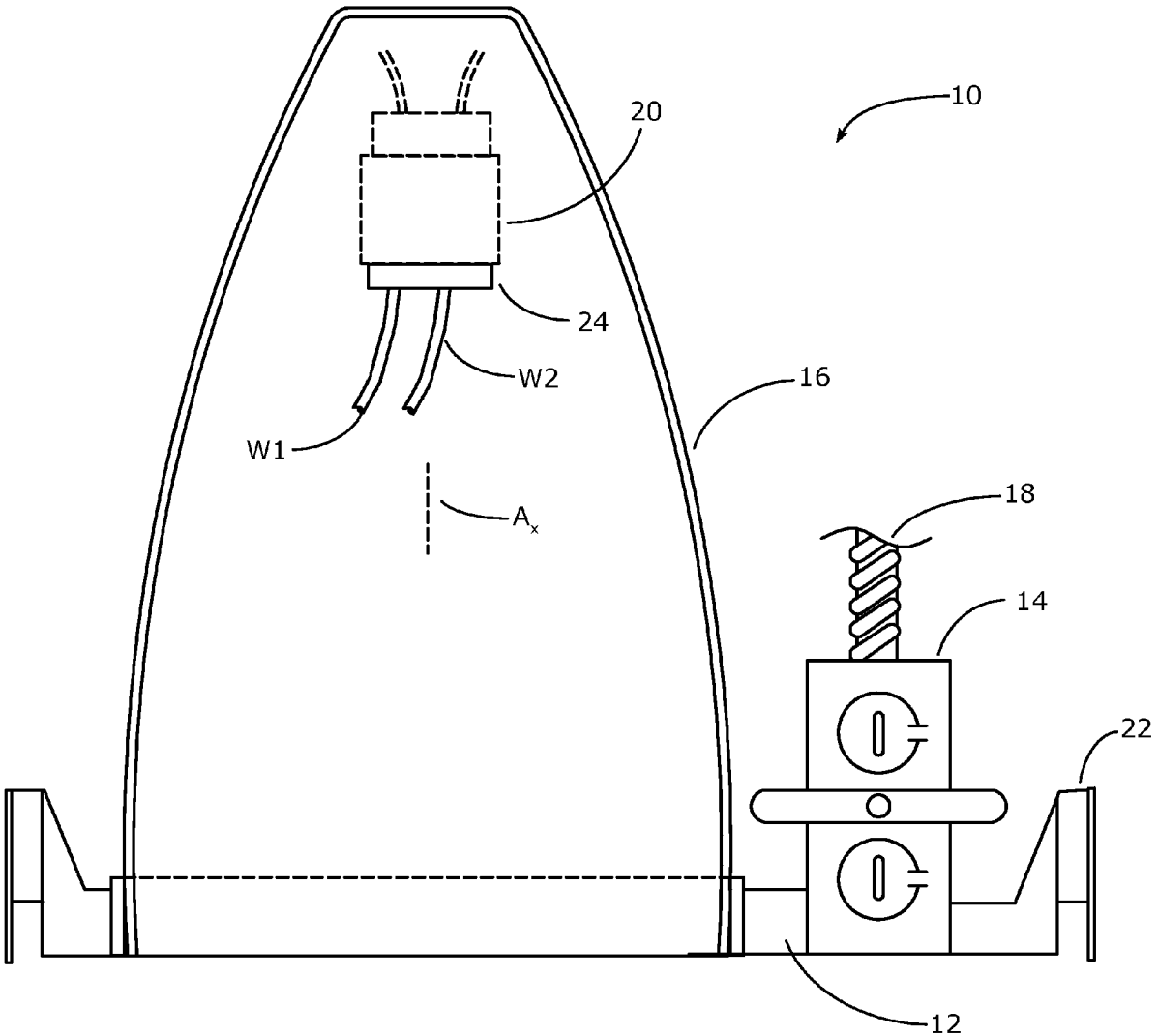
FIG. 1 is a side-elevational view, in partial cross-section, of a generalized or representative can light assembly.

A preferred embodiment of the present invention is assembled from a plurality of surface-engagement shoes 26, as shown in FIGS. 2*a*-2*e*. Each shoe 26 is formed from a band of sheet-metal that is shaped to have a generally or approximately circular curved portion 28 that subtends a selected arc from a center. In general, the curved portion subtends a 90-150 degrees of arc; although smaller and larger values are within the scope of the invention. Selected lengths at the opposite ends of the curved portion 28 are bent inward along a chord line to form flanges 30 and 32. If desired, strengthening ribs, as represented at 34, can be provided for each flange 30. Additionally, at least one mounting tab 36 having a threaded hole 38 is provided at a position along the curved portion 28. In the example shown in FIGS. 2 and 3, the curved portion 28 is formed on a diameter line of about four inches and is intended for use with cans 16 having a lower, open end with a diameter of about four inches; as can be appreciated the radius of the curved portion 28 can be adjusted to accommodate diameters larger than or smaller than four inches.

Figure 2A:
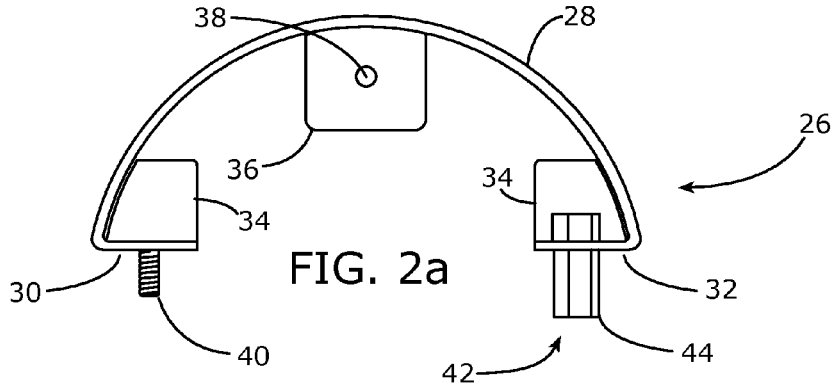
FIG. 2*a* is a top view of a representative surface-engagement shoe.
Figure 2B:
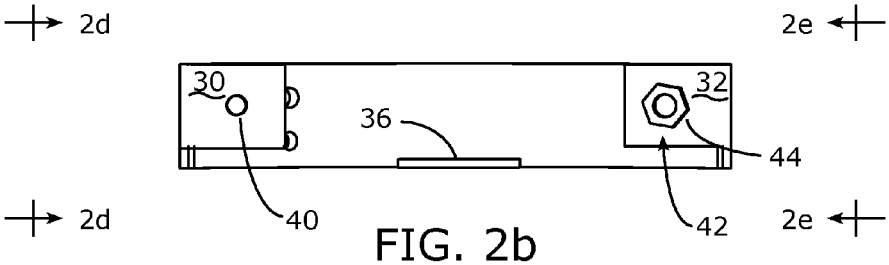
FIG. 2*b* is end view of the representative surface-engagement shoe of FIG. 2*a;*
Figure 2C:
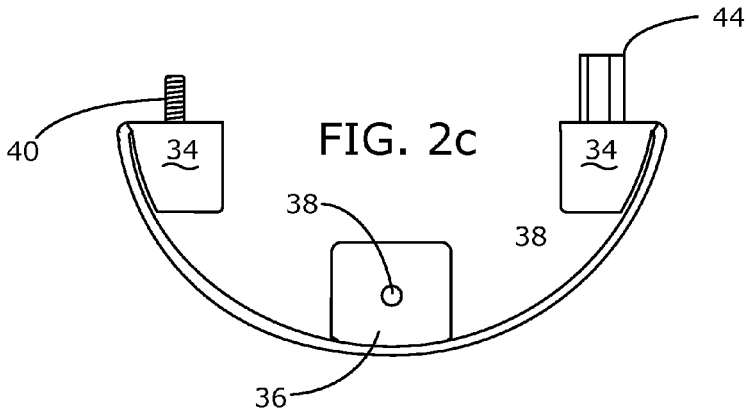
FIG. 2*c* is a bottom view of the representative surface-engagement shoe of FIG. 2*a;*

As shown on the left in FIG. 2*a*, the flange 30 is provided with an externally threaded screw 40 (or similar component) that is threaded into an appropriately threaded hole (not shown) with the screw 40 tightened in place and, if desired, additionally held in place with a thread-locking material (e.g., "Loctite"), to provide a fixed-in-place threaded stud.

As shown on the right in FIG. 2*a*, the flange 32 is provided with a freely rotatable coupling sleeve 42. The coupling sleeve assembly 42 includes an internally threaded elongated hex-nut 44 that is mounted to the flange 30 for rotation about the long axis of the hex-nut 44.

Figure 3A:
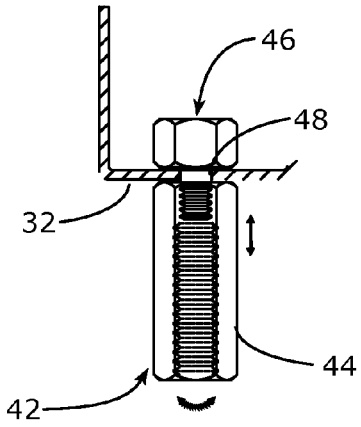
FIG. 3*a* is a detail of a preferred threaded shaft/adjustment sleeve assembly.
Figure 3B:
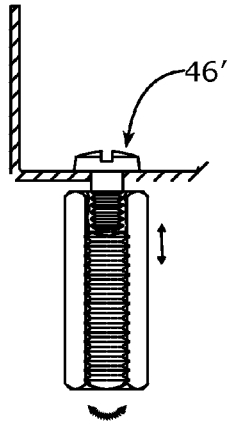
FIG. 3*b* is a detail of another threaded shaft/adjustment sleeve assembly.

As shown in the enlarged detail of FIG. 3*a*, an attachment cap 46 includes an unthreaded shank portion (unnumbered) immediately adjacent the hex-head of the cap 46 and an externally threaded portion (unnumbered) in engagement with the internal threads of the coupling sleeve 44. The attachment cap 46 is passed through a clearance hole 48 in the flange 30 and threaded into one end of the coupling nut 44 and tightened sufficiently that the screw 46 will not loosen in normal use; if desired, a thread locking compound can be used. In general, the axial length of the unthreaded shank portion of the attachment cap 46 is somewhat larger than the thickness of the flange 30 and the diameter of the unthreaded shank portion of the attachment cap 46 is somewhat smaller than that of its mounting hole 48 to provide a "loose" fit. Thus, as shown by the arrows in the detail of FIG. 3*a*, the coupling sleeve 44, in addition to being rotatable about its long axis, can be translated slightly up/down along its long axis and can be moved slightly side-to-side. A variant of the structure shown in FIG. 3*a* is shown in FIG. 3*b*; as shown, the attachment cap 46 of FIG. 3*a* has been replaced by a screw 46' that achieves substantially the same function.

The mounting tab 36 is formed as a bent portion of the sheet metal from which the shoe 26 is formed; the threaded hole 38 is provided with a thread diameter and a pitch as typically used in lighting and lamp assemblies.

Figure 2D:
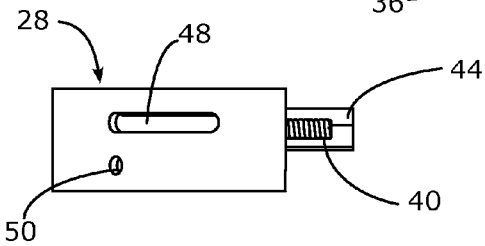
FIG. 2*d* is a side view of the representative surface-engagement shoe of FIG. 2*b* taken along line 2*d*-2*d* in FIG. 2*b;*
Figure 2E:
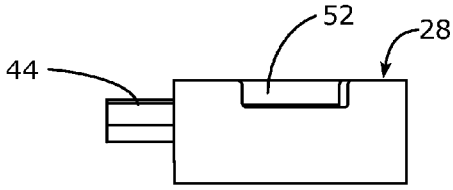
FIG. 2*e* is a side view of the representative surface-engagement shoe of FIG. 2*b* taken along line 2*e*-2*e* in FIG. 2*b;*

As shown in FIGS. 2*d* and 2*e*, the curvilinear band 28 can be provided with various slots 48, holes 50 and notches 52 to assist in securing the adaptor kit in place during installation or for providing access openings for various tools used during the initial manufacture and/or assembly of the shoes 26.

Figure 4A:
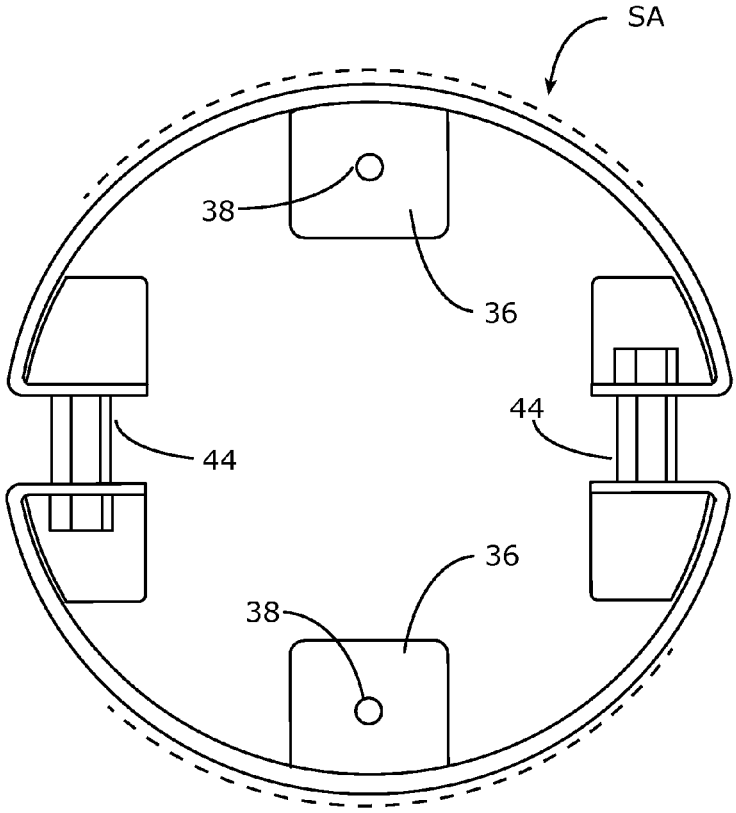
FIG. 4*a* is a plan view of a pair of surface-engagement shoe assembled together to form a shoe assembly.
Figure 4B:
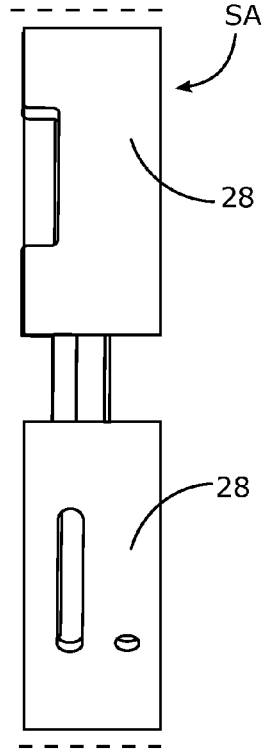
FIG. 4*b* is a side view of the shoe assembly of FIG. 4*a;*

As shown in FIGS. 4*a* and 4*b*, two of the shoes 26 described above are assembled together to form a shoe assembly SA. As shown on the right in FIG. 4*a*, the coupling nut 44 of the upper shoe 26 is threaded into engagement with its fixed-in-place threaded screw 40 (not shown) on the lower shoe 26, and, in a similar manner and as shown on the left in FIG. 4*a*, the coupling nut 44 of the lower shoe 26 is threaded into engagement with its fixed-in-place screw 40 (not shown) of the upper shoe 26. As can be appreciated, rotating both coupling nuts 44 in such a way to unthread them relative to their fixed-in-place screws 40 will cause the shoes 26 to move away from one another toward an extended position, as represented by the dotted-lines in FIGS. 4*a* and 4*b*. In effect, each coupling nut 44 and its respective screw 40 function as a "screw jack" to move the two shoes 26 apart or away from one another to an extended position, and, conversely, to a retracted position when the coupling nuts 44 are counter-rotated.

Figure 5:
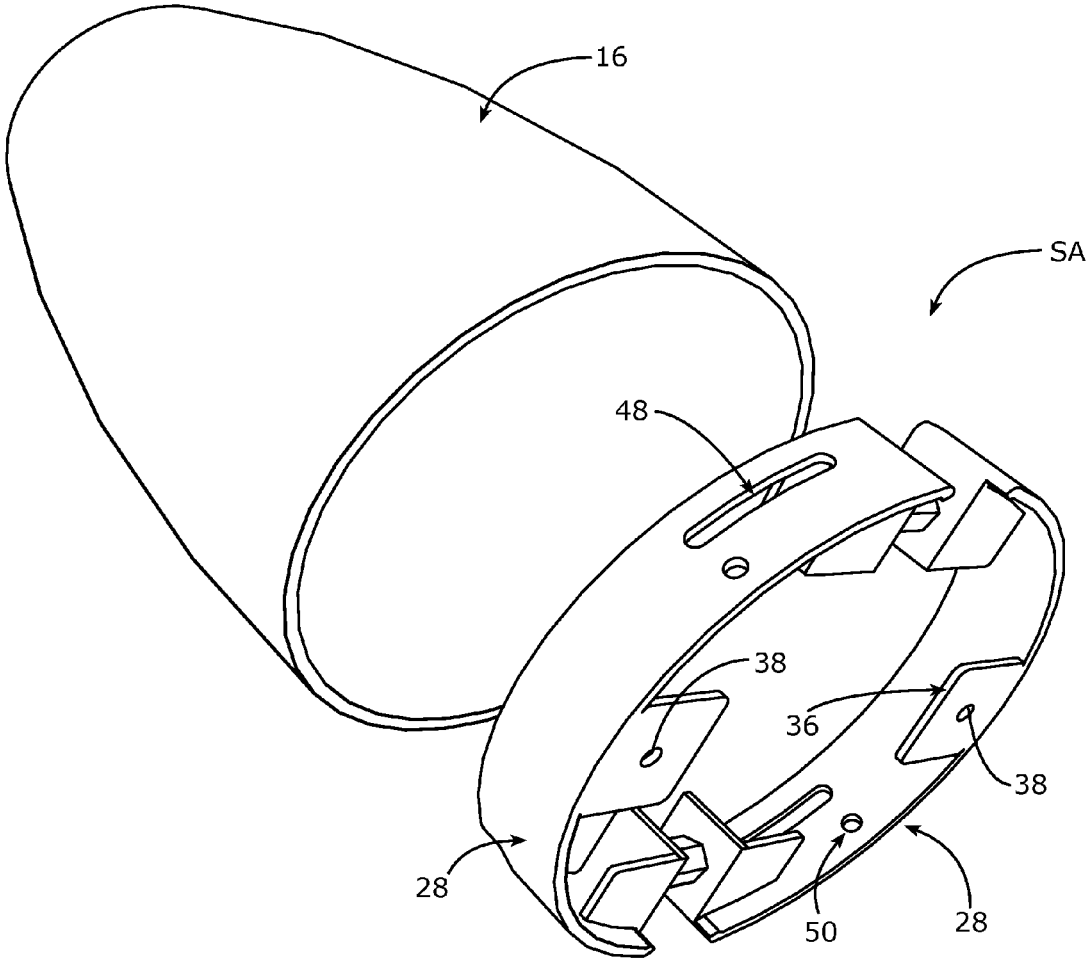
FIG. 5 is an isometric view of a shoe assembly positioned for insertion into the lower end of a representative can.

The shoe assembly SA of FIGS. 4*a* and 4*b* is installed in a can 16 as shown in FIG. 5. As shown, the shoe assembly SA of FIGS. 4*a* and 4*b* is positioned adjacent the open end of the can 16 with the mounting tabs 36 facing away from the open end of the can 16 and with the coupling nuts 44 adjusted so that the shoes 26 are sufficiently retracted that the shoe assembly SA can fit within the open end of the can 16. The shoe assembly SA is positioned at the open end of the can 16, inserted into the open end of the can 16, and held in place; the coupling nuts 44 are both appropriately rotated to cause the shoes 26 to move away from one another toward an extended position. At some point in this process, one or more portions of the peripheral surfaces 28 of the shoes 26 will contact the inside diameter surface of the can 16 to effect a frictional interengagement therewith. In general, the shoes 26 are extended to the point that a substantially rigid relationship is established such that the shoe assembly SA is frictionally locked in place such that more than 10-80 pounds of force would be required to pull the shoe assembly SA from the can 16.

In general, the coupling nuts 44 can be rotated using the installer's fingers and further tightened using an appropriately sized fixed or adjustable open-end wrench or gripping tools, such as a pair of pliers. In some cases, the extended shoes 26 can cause a deformation of the lower end of the can 16; in general, some deformation is acceptable.

After the shoe assembly SA is installed, one or more self-tapping screws (not shown) can be inserted to any of the holes 50 or slots 52 formed in each shoe 26 to further secure the shoe assembly SA in place.

Figure 6A:
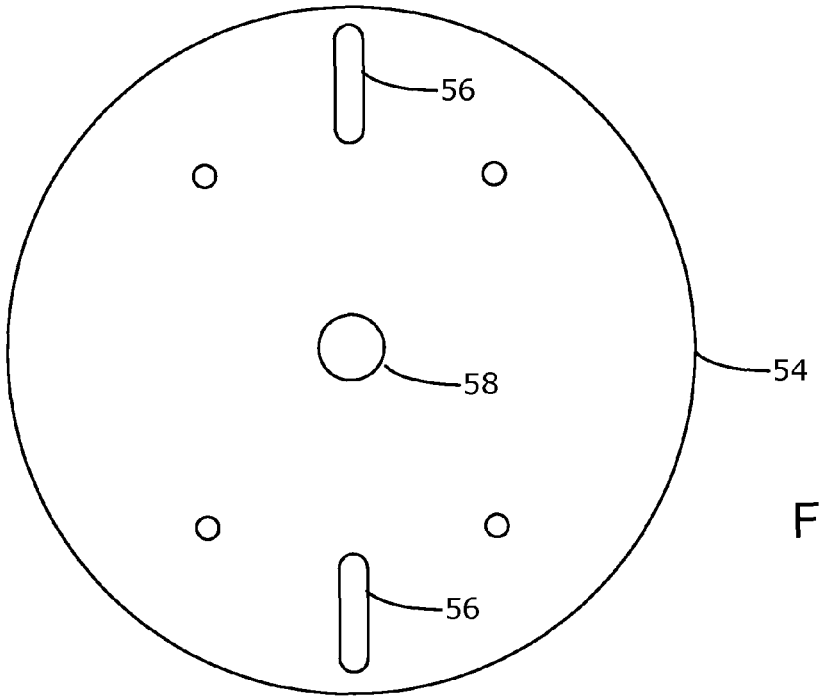
FIG. 6*a* is a plan view of a cover plate.
Figure 6B:
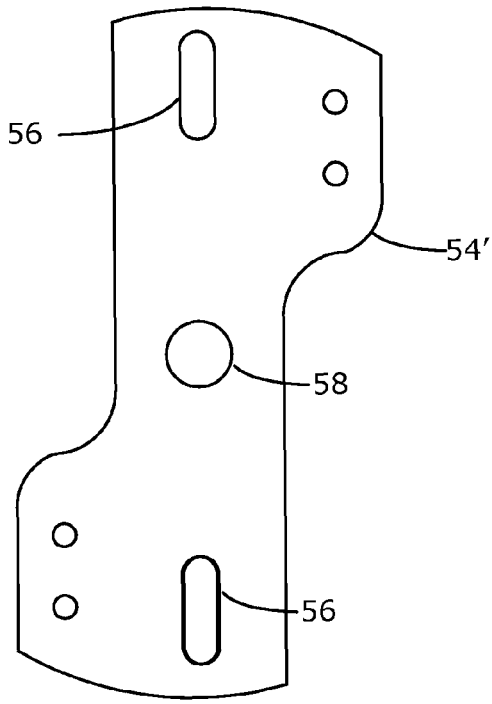
FIG. 6*b* is a plan view of a cross-bar.

Once the shoe assembly is installed in place, an appropriate cover or cross-bar is installed; an example cover plate 54 and an example cross-bar 54' are shown in FIGS. 6*a* and 6*b*, respectively. As shown, the cover plate 54 in FIG. 6*a* is generally circular and includes slots 56 and a center hole 58. In the similar manner, the cross-bar 54' also includes slots 56 and a center hole 58. The cover plate 54 or cross-bar 54' is installed using conventional screws that pass through the slots 56 and engage with the threaded hole 38 in each mounting tab 36 to secure the parts together. The central hole 58 threaded to accept standard-sized externally threaded pipe (e.g., ⅛-IP or ¼-IP) as used in the lighting industry; the threaded pipe is hollow so that the electrical wires W1 and W2, mentioned above in relationship to FIG. 1, can be passed through the threaded pipe to extend from the bottom of the pipe for connection to the lamp or light assembly. Additionally, the connection plate 54 or cross-bar 54' can include miscellaneous holes for attaching various devices (i.e., the hardware supplied with various hanging lamps, flush-mount lamps, and/or other lighting fixtures or devices, etc.).

Figure 7A:
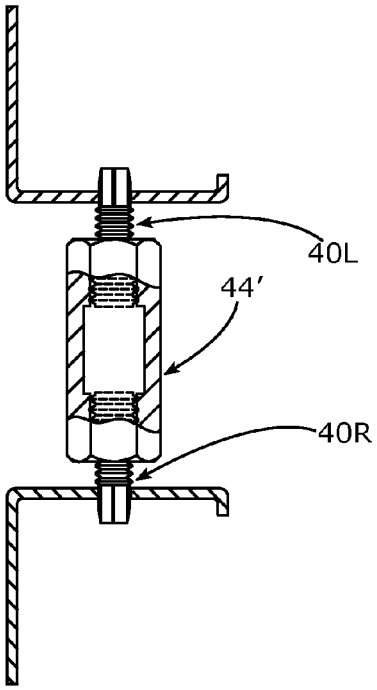
FIGS. 7*a* and 7*b* are details views of another threaded shaft/adjustment sleeve assembly.
Figure 7B:
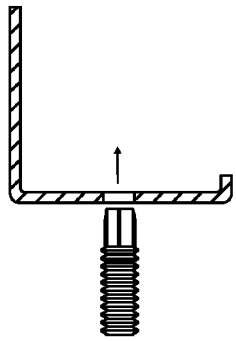

In the embodiment described above, a rotatably mounted coupling nut 44 cooperates with its respective screw 40 to move the shoes 26 toward or away from each other. Other arrangements are equally suitable, for example, in the variant shown in FIG. 7*a*, the elongated coupling nut 44' is formed with internal left-hand threads at one end and internal right-hand threads at the other end. Appropriate left-hand and right-hand fixed-in-place threaded stub-stafts 40R and 40L are provided in each flange to engage the coupling nut 44' and accomplish the "screw jack" function described above. As shown in FIG. 7*b*, the stub-shafts can be installed in the flanges by providing each stub-shaft with a tapered, unthreaded end with longitudinally aligned fins. The end of the stub-shaft is then forced into an undersized hole in the flange to effect a 'staking' of the stub-shaft to the flange. If desired, the end portion of the stub-shaft can then swaged to fix the stub-shaft in place on the flange. In a similar manner to the "screw jack" arrangement described above in relationship to FIGS. 4*a* and 4*b*, each coupling nut 44' of FIGS. 7*a* and 7*b* also functions as a "screw jack" to move the two shoes 26 apart or away from one another to an extended position, and, conversely, to a retracted position when the coupling nuts 44' are counter-rotated.

Figure 8:
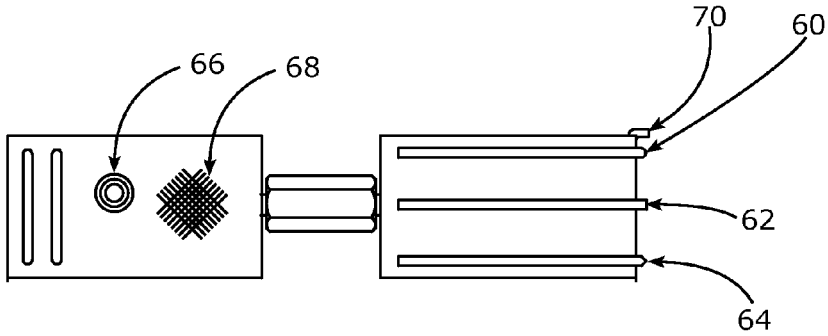
FIG. 8 is view similar to that of FIG. 4*b* showing a variant thereof.

In the preferred embodiment described above, the surface 28 of each shoe 26 is shown as a relatively smooth curved surface; as can be appreciated, other non-smoothly curved variants are possible and fall with the definition of the shoes having surface portions thereof approximately conform to the interior curvature or radius surface of the can 16. For example and as shown on the right in FIG. 8, one or more continuous (or interrupted) ribs can be provided on the surface 28 along the major dimension of the surface 28, or as shown on the left in FIG. 8, along the minor dimension of the surface 28. As shown on the right in FIG. 8, the ribs can have various configurations including, but not limited to, a rounded configuration 60, a square-edged configuration, 62 and/or a pointed configuration 64. In addition, spike-like extension can also be used. Also and as shown on the left in FIG. 8, various friction-enhancements can be provided, such as repeating concentric-circle patterns 66 or cross-hatching patterns 68 formed in/on the surface 28 as well the application of chalks, mastics, and/or pressure sensitive adhesives or other compounds to enhance the engagement of each shoe 26 with the inner wall surface at or near the lower end of the can 16.

If desired, a peripheral flange or flanges 70 can be used along one or both edges of each shoe 26.

Figure 9A:
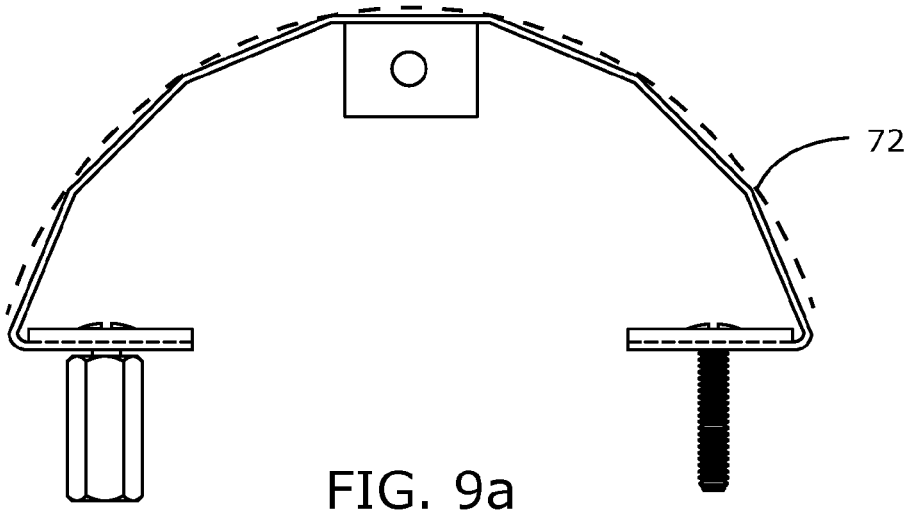
FIGS. 9*a* and 9*b* are views similar to that of FIG. 2*a* showing variants thereof.

As shown in FIG. 9*a*, that portion of the shoe 26 that engages with the inner wall surface at or near the lower end of the can 16 can take the form of a partial polygonal configuration to provide "corners" 72 that can be viewed as "biting" into the can 16 to enhance engagement and also defining surface portions thereof that approximately conform to the interior curvature or radius surface. While FIG. 9*a* shows six such corners 72, other arrangements are suitable including the three corner organization of FIG. 9*b*. The corners 72 can be sharp edged or radiused, as desired. Further variants include but are not limited to sinuous, scalloped, and zig-zag type configurations.

Figure 9B:
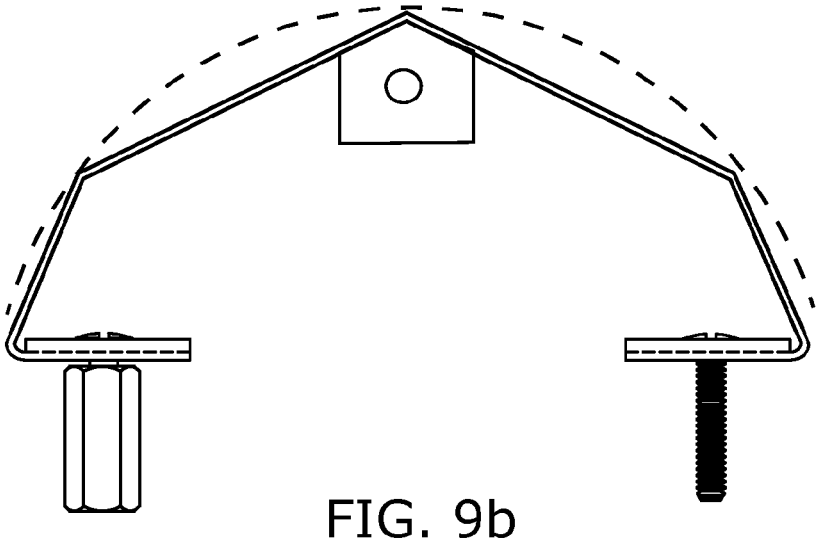

In the embodiment of FIGS. 2*a*-2*e* described above, the curved portion of the shoe 26 that comes into contact with the can 16 is continuously curved at some radius that approximates that of the can. The arrangement of FIGS. 9*a* and 9*b* is not continuously curved but, as shown by the curved dotted-lines, also approximates the radius of the can by effecting contact at plural points at the corners 72. Thus, both the embodiment of FIGS. 2*a*-2*e* and FIGS. 9*a*-9*b* can be said to approximate the radius (or the diameter) or approximately conform to the interior surface of the can into which the shoe assembly SA is fitted.

In the embodiment of FIGS. 2*a*-2*e* described above, the shoe 26 is provided with an externally threaded stub-shaft 40 on one of the flanges and the rotatably mounted sleeve nut 44 on the other flange; this configuration is preferred shoes of this configuration can be assembled to each other. If desired, one shoe can have a externally threaded stub-shaft 40 on each of its mounting flanges and the other shoe can have a rotatably mounted sleeve nut 44 on each of its flanges.

While the preferred embodiment has been disclosed as manufactured from sheet metal, as can be appreciated, molded of formed plastic and/or fiber-reinforced plastics can be used exclusively or in combination with metal sub-parts.

As will be apparent to those skilled in the art, various changes and modifications may be made to the illustrated embodiment of the present invention without departing from the spirit and scope of the invention as determined in the appended claims and their legal equivalent.

The invention claimed is:

1. An adaptor kit for converting a can light of the type having an opening into an interior portion thereof defined by interior surfaces, the kit adapting the can light to accept auxiliary fixtures, the adaptor kit comprising:

a shoe assembly having first and second shoes, each shoe having a surface portion thereof approximately conforming to a selected radius, a surface portion of the first shoe for contacting a first portion of the interior surface of a can light and a surface portion of the second shoe for contacting another portion of the interior surface of a can light; and means for moving said first shoe and said second shoe to an extended position so a part or parts of the surface portion of the first shoe and a part or parts of the surface portion of the second shoe effects contact with respective portions of the interior surface of a can light sufficient to hold the shoe assembly in place in the can light;

wherein said means for moving comprises at least one externally threaded member fixed in place on a one of said shoes and at least one internally threaded member rotatably mounted on the other of said shoes, the externally and internally threaded members in threaded engagement with one another, rotation of the internally threaded member relative to the externally threaded member causing said first and second shoes to move toward the extended position.

2. The adaptor kit of claim 1, wherein said means for moving further comprises:

an externally threaded member fixed in place on each of said first and second shoes and an internally threaded member mounted on each of said shoes for rotation about an axis thereof, the externally threaded member of said first shoe in threaded engagement with the internally threaded member of said second shoe and the internally threaded member of said second shoe in threaded engagement with the externally threaded member of said first shoe, rotation of the internally threaded members relative to their respective externally threaded member causing said first and second shoes to move toward the extended position.

3. An adaptor kit for converting a can light of the type having an opening into an interior portion thereof defined by interior surfaces, the kit adapting the can light to accept auxiliary fixtures, the adaptor kit comprising:

a shoe assembly having first and second shoes, each shoe having a surface portion thereof approximately conforming to a selected radius, a surface portion of the first shoe for contacting a first portion of the interior surface of a can light and a surface portion of the second shoe for contacting another portion of the interior surface of a can light; and means for moving said first shoe and said second shoe to an extended position so a part or parts of the surface portion of the first shoe and a part or parts of the surface portion of the second shoe effects contact with respective portions of the interior surface of a can light sufficient to hold the shoe assembly in place in the can light;

wherein said means for moving comprises:

a one of said first and second shoes having two externally threaded members fixed thereto having a right-hand thread;

the other of said first and second shoes having two externally threaded members fixed thereto having a left-hand thread, a first internally threaded member internally threaded at one end with a left-hand thread and internally threaded at the other end with a right-hand thread, said first internally threaded member in threaded engagement at one end thereof with a right-hand threaded member of said one shoe and in threaded engagement at the other end thereof with a left-hand threaded member of said other shoe; and a second internally threaded member internally threaded at one end with a lefthand thread and internally threaded at the other end with a right-hand thread, said second internally threaded member in threaded engagement at one end thereof with a right-hand threaded member of said one shoe and in threaded engagement at the other end thereof with a left-hand threaded member of said other shoe.

4. The adaptor kit of claim 1, wherein said surface portion approximately conforming to a selected radius includes means for enhancing a friction-fit between the interior surface of the can light and the shoe assembly.

5. The adaptor kit of claim 1, wherein said surface portion approximately conforming to a selected radius comprises a curved surface that subtends a selected arc from a center.

6. The adaptor kit of claim 1, wherein said surface portion approximately conforming to a selected radius comprises a partial polygonal surface that subtends a selected arc from a center.

7. The adaptor kit of claim 1, wherein said surface portion includes at least one hole therethrough.

8. The adaptor kit of claim 1, further comprising a mounting tab having a threaded hole therein attached to or part of the said surface portion approximately conforming to a selected radius.

9. An adaptor kit for converting a can light of the type having an opening into an interior portion thereof defined by interior surfaces, the kit adapting the can light to accept auxiliary fixtures, the adaptor kit comprising:

a first shoe having a surface portion thereof approximately conforming to a selected radius for contacting a first portion of the interior surface of a can light;

a second shoe having a surface portion thereof approximately conforming to a selected radius for contacting a second portion of the interior surface of a can light;

a first screw jack assembly connected between the first shoe and the second shoe;

a second screw jack assembly connected between the first shoe and the second shoe, each screw jack assembly having a rotatable member for moving said first and second shoe away from one another when the respective rotatable member is rotated in a selected direction.

10. The adaptor kit of claim 9, wherein each of said first and second screw jack assembly comprises:

at least one externally threaded member fixed in place on a one of said shoes and at least one internally threaded member rotatably mounted on the other of said shoes, the externally and internally threaded members in threaded engagement with one another, rotation of the internally threaded member relative to the other externally threaded member causing said first and second shoes to move toward the extended position.

11. The adaptor kit of claim 9, wherein each of said first and second screw jack assembly comprises:

an externally threaded member fixed in place on each of said first and second shoes and an internally threaded member mounted on each of said shoes for rotation about an axis thereof, the externally threaded member of said first shoe in threaded engagement with the internally threaded member of said second shoe and the internally threaded member of said second shoe in threaded engagement with the externally threaded member of said first shoe, rotation of the internally threaded members relative to their respective externally threaded member causing said first and second shoes to move toward the extended position.

12. The adaptor kit of claim 9, wherein each of said first and second screw jack assembly comprises:

a one of said first and second shoes having two externally threaded members fixed thereto having a right-hand thread;

the other of said first and second shoes having two externally threaded members fixed thereto having a left-hand thread, a first internally threaded member internally threaded at one end with a left-hand thread and internally threaded at the other end with a right-hand thread, said first internally threaded member in threaded engagement at one end thereof with a right-hand threaded member of said one shoe and in threaded engagement at the other end thereof with a left-hand threaded member of said other shoe; and a second internally threaded member internally threaded at one end with a lefthand thread and internally threaded at the other end with a right-hand thread, said second internally threaded member in threaded engagement at one end thereof with a right-hand threaded member of said one shoe and in threaded engagement at the other end thereof with a left-hand threaded member of said other shoe.

13. The adaptor kit of claim 9, wherein said surface portion approximately conforming to a selected radius includes means for enhancing a friction-fit between the interior surface of the can light and the shoe assembly.

14. The adaptor kit of claim 9, wherein said surface portion approximately conforming to a selected radius comprises a curved surface that subtends a selected arc from a center.

15. The adaptor kit of claim 9, wherein said surface portion approximately conforming to a selected radius comprises a partial polygonal surface that subtends a selected arc from a center.

16. The adaptor kit of claim 9, wherein said surface portion includes at least one hole therethrough.

17. The adaptor kit of claim 9, further comprising a mounting tab having a threaded hole therein attached to or part of the said surface portion approximately conforming to a selected radius.

18. An adaptor kit for converting a can light of the type having an opening into an interior portion thereof defined by interior surfaces, the kit adapting the can light to accept auxiliary fixtures, the adaptor kit comprising:

a first shoe having a surface portion thereof approximately conforming to a selected radius for contacting a first portion of the interior surface of a can light, said first shoe having an externally threaded member fixed in place thereon and having an externally threaded member mounted thereto for rotation about an axis thereof;

a second shoe having a surface portion thereof approximately conforming to a selected radius for contacting a second portion of the interior surface of a can light, said second shoe having an externally threaded member fixed in place thereon and having an externally threaded member mounted thereto for rotation about an axis thereof;

the externally and internally threaded members of said first and second shoes in threaded engagement with one another, rotation of the internally threaded member relative to its respective other externally threaded member causing said first and second shoes to move toward the extended position.

19. A mounting shoe for use in converting a can light of the type having an opening into an interior portion thereof defined by interior surfaces, the mounting shoe for adapting the can light to accept auxiliary fixtures, comprising:

a surface portion thereof approximately conforming to a selected radius that subtends a selected arc from a center for contacting a first portion of an interior surface of a can light;

first flange and second flange connected to said surface portion, and an externally threaded member fixed to a one of said first and second flanges and a internally threaded member rotatably coupled to the other of said first and second flanges.

* * * * *